US009890021B2

(12) United States Patent
Rodenburg

(10) Patent No.: US 9,890,021 B2
(45) Date of Patent: Feb. 13, 2018

(54) WINCH CONTROL ARRANGEMENT COMPRISING A RETAINING DEVICE FOR A CABLE AND METHOD FOR OPERATING SUCH AN ARRANGEMENT

(71) Applicant: NOVATUG HOLDING B.V., Alphen aan den Rijn (NL)

(72) Inventor: Robert Rodenburg, Alphen aan den Rijn (NL)

(73) Assignee: NOVATUG HOLDING B.V., Alphen aan den Rijn (NL)

( * ) Notice: Subject to any disclaimer, the term of this patent is extended or adjusted under 35 U.S.C. 154(b) by 199 days.

(21) Appl. No.: 14/908,069

(22) PCT Filed: Jul. 24, 2014

(86) PCT No.: PCT/NL2014/050506

§ 371 (c)(1),
(2) Date: Jan. 27, 2016

(87) PCT Pub. No.: WO2015/012691

PCT Pub. Date: Jan. 29, 2015

(65) Prior Publication Data

US 2016/0159624 A1 Jun. 9, 2016

(30) Foreign Application Priority Data

Jul. 26, 2013 (NL) ..... 2011226

(51) Int. Cl.
*B66D 1/30* (2006.01)
*B66D 1/38* (2006.01)
(Continued)

(52) U.S. Cl.
CPC ..... *B66D 1/38* (2013.01); *B63B 35/68* (2013.01); *B66C 1/42* (2013.01); *B66D 1/30* (2013.01)

(58) Field of Classification Search
CPC .. B63B 35/68; B66D 1/30; B66D 1/38; B66D 1/42
See application file for complete search history.

(56) References Cited

U.S. PATENT DOCUMENTS 1,403,021 A * 1/1922 Fogal ..... B66D 1/30 187/315
2,348,987 A * 5/1944 Lock ..... B66D 1/38 200/47
(Continued)

FOREIGN PATENT DOCUMENTS

DE 31 49 589 A1 6/1983
DE 3149589 A1 * 6/1983 ..... B66D 1/30
(Continued)

OTHER PUBLICATIONS

International Search Report, dated Nov. 17, 2014, from corresponding PCT Application.

*Primary Examiner* — Emmanuel M Marcelo
(74) *Attorney, Agent, or Firm* — Young & Thompson

(57) ABSTRACT

Disclosed is a winch control arrangement, including a retaining device for a cable, a rotatable drum having a rotational axis, and a substantially circular, centric storage part with a storage surface containing at least two windings of cable. The distance of the storage surface to the rotational axis is substantially constant. An eccentric holding part with a holding surface contains at least two cable windings. The distance of the holding surface to the rotational axis varies around the circumference of the holding part. A cable guide lies at a perpendicular distance from the rotational axis and the drum itself, and is movable substantially parallel to the rotational axis between a first position allowing cable winding on the centric storage part and a second position allowing cable winding on the eccentric part. The cable guide is connected to automatic movement unit for moving the cable guide between the two positions.

20 Claims, 3 Drawing Sheets

(51) Int. Cl.
*B63B 35/68* (2006.01)
*B66C 1/42* (2006.01)

(56) References Cited

U.S. PATENT DOCUMENTS

| | | | | | |
|---|---|---|---|---|---|
| 2,424,380 | A * | 7/1947 | Barker | B66D 1/36 | 242/397.3 |
| 2,922,599 | A * | 1/1960 | Bigelow | B65H 54/2851 | 242/157.1 |
| 3,144,998 | A | 8/1964 | Back | | |
| 5,746,149 | A | 5/1998 | Molz | | |
| 6,182,592 | B1 * | 2/2001 | Molz | B63B 21/16 | 114/230.2 |
| 2006/0226278 | A1 * | 10/2006 | Van Der Laan | B66D 1/30 | 242/603 |
| 2009/0309084 | A1 * | 12/2009 | Kempf | B66C 9/02 | 254/375 |
| 2015/0008381 | A1 * | 1/2015 | Hausladen | B66D 1/30 | 254/288 |

FOREIGN PATENT DOCUMENTS

| | | | |
|---|---|---|---|
| GB | 2 296 229 | A | 6/1996 |
| WO | 01/30650 | A1 | 5/2001 |
| WO | 2005/019088 | A1 | 3/2005 |

* cited by examiner

WINCH CONTROL ARRANGEMENT COMPRISING A RETAINING DEVICE FOR A CABLE AND METHOD FOR OPERATING SUCH AN ARRANGEMENT

FIELD OF THE INVENTION

The invention relates to a retaining device for a cable, comprising a rotatable drum having a rotational axis, comprising a substantially circular, centric storage part with a storage surface for containing at least two windings of cable, wherein the distance of the storage surface to the rotational axis is substantially constant, and an eccentric holding part with a holding surface for containing at least two windings of cable, wherein the distance of the holding surface to the rotational axis varies around the circumference of the holding part, wherein a cable guide is arranged at a perpendicular distance from the rotational axis and the drum itself, the cable guide being movable in a movement direction substantially parallel to the rotational axis between a first position for allowing the cable to be wound up on the centric storage part and a second position for allowing the cable to be wound up on the eccentric part, wherein the cable guide is connected to automatic movement means for moving the cable guide between the first and the second positions. The invention in particular relates to a winch control arrangement comprising such a retaining device and a method for operating such a winch control arrangement.

BACKGROUND OF THE INVENTION

Such a retaining device is known from the PCT patent publication WO 2005/019088. This publication describes a retaining device for a cable consisting of a rotary drum around which at least two cable windings are made, wherein retaining and paying out are being made possible by means of a motor that drives the drum. The axis of rotation for the drive is offset with respect to the axis of the drum, so that in a certain position the axis of rotation is essentially coincident with the casing face of the drum engaging on the cable. The cable guide can be moved by a cable guide actuating mechanism.

U.S. Pat. No. 3,144,998 describes a winch control arrangement wherein a freewheeling pulley is positioned in front of a cable drum to guide a cable around the cable drum. The pulley can be moved laterally, parallel to the rotational axis of the drum, to guide the cable to the intended part of the cable drum. A construction with several control cables allows lateral pulling forces to be exerted on the pulley to force it to move. This construction, however, is rather complex mechanically and relatively unreliable in real-life conditions at sea.

A disadvantage of the known retaining device, and a winch control arrangement comprising such a retaining device, is that in order to move the cable guide from the centric storage part to the eccentric holding part, an operator will have to get close to the device to cause the cable guide actuating mechanism to change the position of the cable guide. Especially when using the retaining device with a carrousel type of tug, as disclosed in e.g. WO 01/30650, the operator will be exposed to injury, due to possible volatile movement of the platform on which the operator is standing.

It is therefore an object of the present invention to provide a retaining device, in particular a winch control arrangement comprising such a retaining device, wherein the operator can cause the automatic movement means to change the position of the cable guide without exposing himself to danger and preferably even without requiring visual control.

SUMMARY OF THE INVENTION

Hereto, a winch control arrangement is provided, comprising a retaining device for a cable, comprising a rotatable drum having a rotational axis, comprising a substantially circular, centric storage part with a storage surface for containing at least two windings of cable, wherein the distance of the storage surface to the rotational axis is substantially constant, and an eccentric holding part with a holding surface for containing at least two windings of cable, wherein the distance of the holding surface to the rotational axis varies around the circumference of the holding part, wherein a cable guide is arranged at a perpendicular distance from the rotational axis and the drum itself, the cable guide being movable in a movement direction substantially parallel to the rotational axis between a first position for allowing the cable to be wound up on the centric storage part and a second position for allowing the cable to be wound up on the eccentric part, wherein the cable guide is connected to automatic movement means for moving the cable guide between the first and the second positions, wherein the automatic movement means are configured to be controllable by remote control means, and remote control means arranged at a distance from the retaining device, wherein the remote control means are communicatively connected to the retaining device for controlling the operation of the automatic movement means, wherein the remote control means are configured to automatically cause the automatic movement means to move the cable guide from the second position to the first position when a signal is given via the remote control means to start paying in or paying out of the cable and/or to move the cable guide from the first position to the second position when a signal is given via the remote control means to stop paying in or paying out of the cable.

Due to the fact that the automatic movement means of the cable guide are connected to remote control means arranged at a distance from the retaining device for moving the cable guide between the first and the second positions, manual operation of the retaining device, i.e. local control, by an operator is no longer required and can be carried out remotely. In this way, visual control is also no longer required. Remote control can for instance be carried out e.g. from the wheelhouse/pilothouse.

Furthermore, the above-described winch control arrangement only requires the operator to give a single signal, e.g. by pressing a button on the remote control means, to start paying out (veering) or paying in (hauling) of the cable.

Preferably, when a predetermined amount of cable has been hauled in/veered out, the remote control means automatically cause the cable guide to move to the eccentric holding part in order to arrange a certain amount of windings thereon sufficient for holding the cable securely on that eccentric holding part.

Automatic movement means are to be understood as means that do not require the operator's muscular force to change positions, with the only intervention by the operator being required being the initiation of the positional change of the cable guide via a signal means, such as a button, lever or the like. Furthermore, the communicative connection preferably encompasses electronic communication means, such as electrical cabling or the like, or maybe even wireless radio transmission means.

Another embodiment relates to an aforementioned winch control arrangement, comprising guide means for guiding the movement of the cable guide between the first and the second positions, wherein the automatic movement means comprise a push-pull device attached to drive means to push or pull the cable guide along the guide means between the first and second positions. Such a push-pull device constitutes a reliable way of effecting the positional change of the cable guide, especially in harsh conditions such as at sea.

Another embodiment relates to an aforementioned winch control arrangement, wherein the guide means comprise one or more rods extending in the movement direction, wherein the cable guide is slideably arranged on the one or more rods. Such a rod arrangement further increases the operational reliability of the automatic movement means, especially when large forces are present, such as when a tug on which the retaining device may be installed, is pulling a large vessel, such as an oil tanker. Furthermore, the rods allow more accurate positioning of the cable guide.

Another embodiment relates to an aforementioned winch control arrangement, wherein the one or more rods comprise a pair of rods and the push-pull device extends between the pair of rods, in the movement direction. This allows for more symmetric force distributions and thus more reliable operation of the movement means.

Another embodiment relates to an aforementioned winch control arrangement, wherein the push-pull device comprises a hydraulic actuator. Such a hydraulic actuator is able to exert relatively large forces on the cable guide within a short time span, thus enabling the cable guide to move quickly from the first to the second positions and vice versa.

Another embodiment relates to an aforementioned winch control arrangement, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position. In this way, the arrangement is even further automated.

Another embodiment relates to an aforementioned winch control arrangement, wherein the remote control means comprise a programmable logic controller (PLC). Such a PLC is especially suitable for sequential control operations, such as with the above winch control arrangement.

Another aspect of the invention relates to a tug comprising an aforementioned winch control arrangement. As mentioned before, the above winch control arrangement is especially suitable for implementation onboard a tug.

Another embodiment relates to an aforementioned tug, wherein the remote control means are arranged in a pilot house of the tug. Thus, the cable guide can be operated from the relative safety of the pilot house, without requiring the operator to come anywhere near the retaining device.

Another aspect of the invention relates to a method for operating a winch control arrangement, comprising the steps of:

- causing the automatic movement means to move the cable guide from the second position to the first position when a signal is given via the remote control means to start paying in or paying out of the cable and/or
- causing the automatic movement means to move the cable guide from the first position to the second position when a signal is given via the remote control means to stop paying in or paying out of the cable.

As mentioned before, this automated procedure thus only requires the operator to give a single signal, e.g. by pressing a button on the remote control means, to start paying out (veering) or paying in (hauling) of the cable.

Another embodiment relates to an aforementioned method, wherein a predetermined amount of windings are unwound from the eccentric holding part prior to moving the cable guide from the second position to the first position and/or a predetermined amount of windings are wound up onto the eccentric holding part after moving the cable guide from the first position to the second position. Thus, no further intervention is required by the user to wind/unwind the cable from the eccentric holding part.

Another embodiment relates to an aforementioned method, wherein the predetermined amount of windings lies between 2-4, preferably is 3. Thus the size, i.e. the length along the rotational axis, of the eccentric holding part can be kept relatively small as to allow relatively quick winding/unwinding and subsequent/prior movement of the cable guide between the first and second positions.

It is noted that another retaining device is known from the German patent publication DE 3149589 A1. The retaining device disclosed therein has a storage drum with a main part provided with grooves for storing a cable and eccentric side parts for holding the cable.

The British patent publication GB 2.296.229 furthermore discloses a winding drum with a cable storage part having a cross-section with an elliptical shape to prevent 'backwinding' from occurring.

BRIEF DESCRIPTION OF THE DRAWINGS

An embodiment of a retaining device according to the invention will by way of non-limiting example be described in detail with reference to the accompanying drawings. In the drawings.

DETAILED DESCRIPTION OF THE INVENTION

Figure 1:
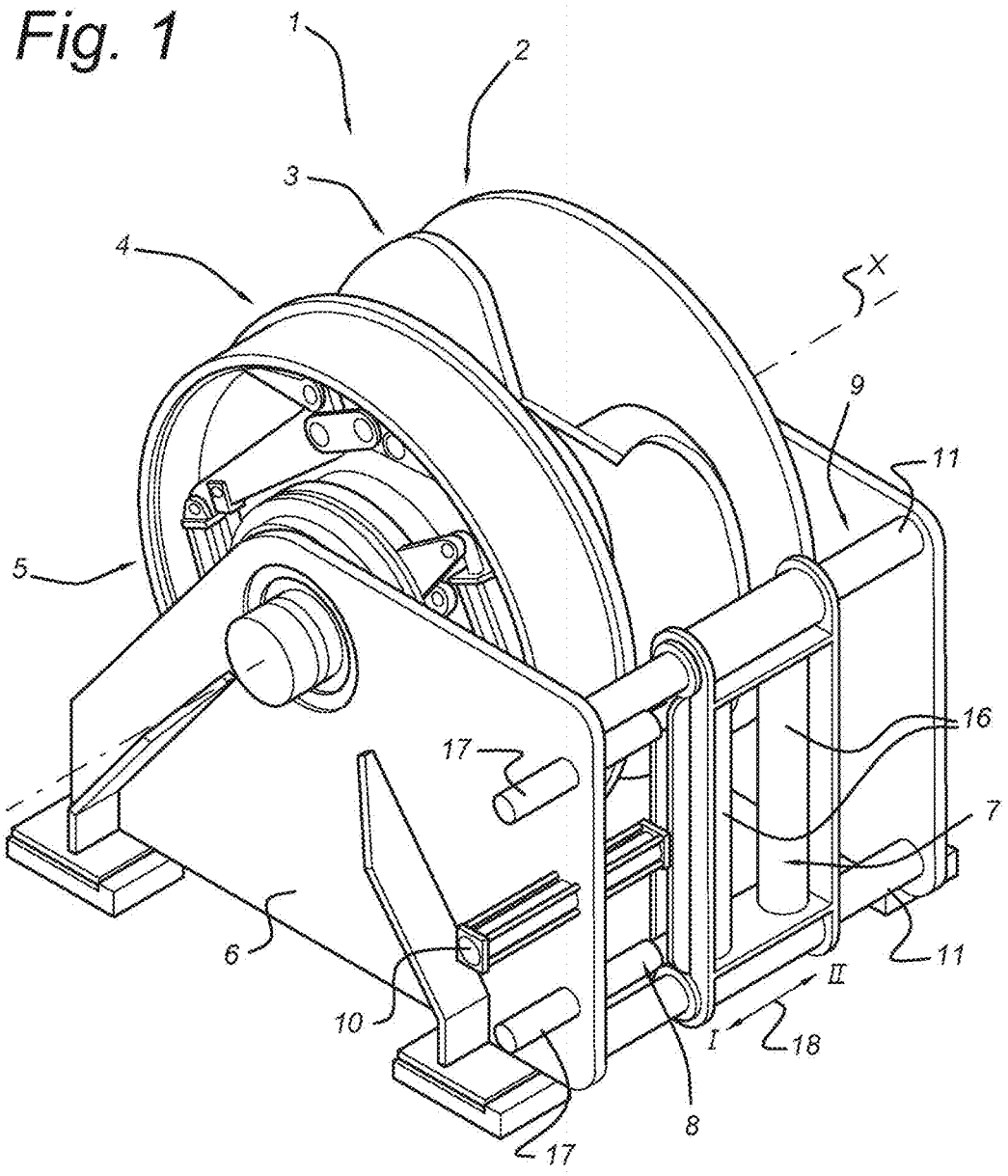
FIG. 1 shows a perspective view of an exemplary embodiment of a retaining device for use with a winch control arrangement according to the invention, at a first angle.

FIG. 1 shows a perspective view of an exemplary embodiment of a retaining device 1 for use with a winch control arrangement according to the invention, at a first angle.

The retaining device 1 comprises a drum 2 that is driven by a motor (not shown) and comprises a brake/locking system 5, such as a drum brake. The drum 2 comprises a bearing (not shown) for allowing rotation of the drum 2 around an axis X. Drum 2 is of circular cylindrical construction. Preferably, the axis X runs in a horizontal direction, or when it is mounted on a tug or similar vessel, parallel to the deck. This ensures the cable, when stored, does not uncontrollably sag downwards due to gravity. Also, the drum diameter is preferably chosen such that synthetic cable, such as Dyneema®, can be used.

The brake/locking system, as mentioned in the foregoing, can advantageously comprise a drum brake. Most winches in use today with tugboats comprise a band brake, comprising a sort of belt that is tightened around a drum flange in order to keep the drum immobilized. In relation to the diameter of the flange, this type of brake has a relatively large braking capacity. However, with such brakes it is not possible to accurately dose the braking power thereof, i.e. it is not possible to allow the cable to veer with the brake slipping. However, with the proposed drum brake, in combination with the retaining device, i.e. having an eccentric holding part, use can be made of a lighter braking mechanism, in particular the aforementioned drum brake.

On the casing face the drum 2 can be provided with peripheral grooves for accommodating two windings of cable. The drum 2 can be designed to accommodate more windings, such as 2-7 windings, however the limit lies preferably at 8 windings to keep the size of the drum 2 in the direction of the rotational axis X low. The drum 2 comprises a centric storage part 4 and an eccentric holding part 3. The operation of this per se known construction will not be further elucidated here.

A cable guide is indicated by 7 that can be moved in the direction of arrow 18 in order to guide the cable into the groove in the correct manner or to guide the cable from the centric part 4 to the eccentric part 3 and vice versa. To do so, the cable guide 7 is attached to automatic movement means 8. The automatic movement means 8 comprise an actuation mechanism and, in the embodiment as shown in FIG. 1, a push-pull device 10, such as a hydraulic actuator, to move the cable guide 7. Preferably, the cable guide 7 is slideably arranged on guide means 9, for instance having the form of a pair of rods 11, to facilitate movement of the cable guide 7 in the movement direction 18. The cable guide 7 may have a rectangular shape, as shown, having short sides and long sides, wherein the short sides are slideable over the rods 11 and the long sides thereof extend perpendicular thereto. The long sides may furthermore may be provided on their inside with cable support rollers 16 to facilitate smooth movement of the cable through the cable guide 7.

Figure 2:
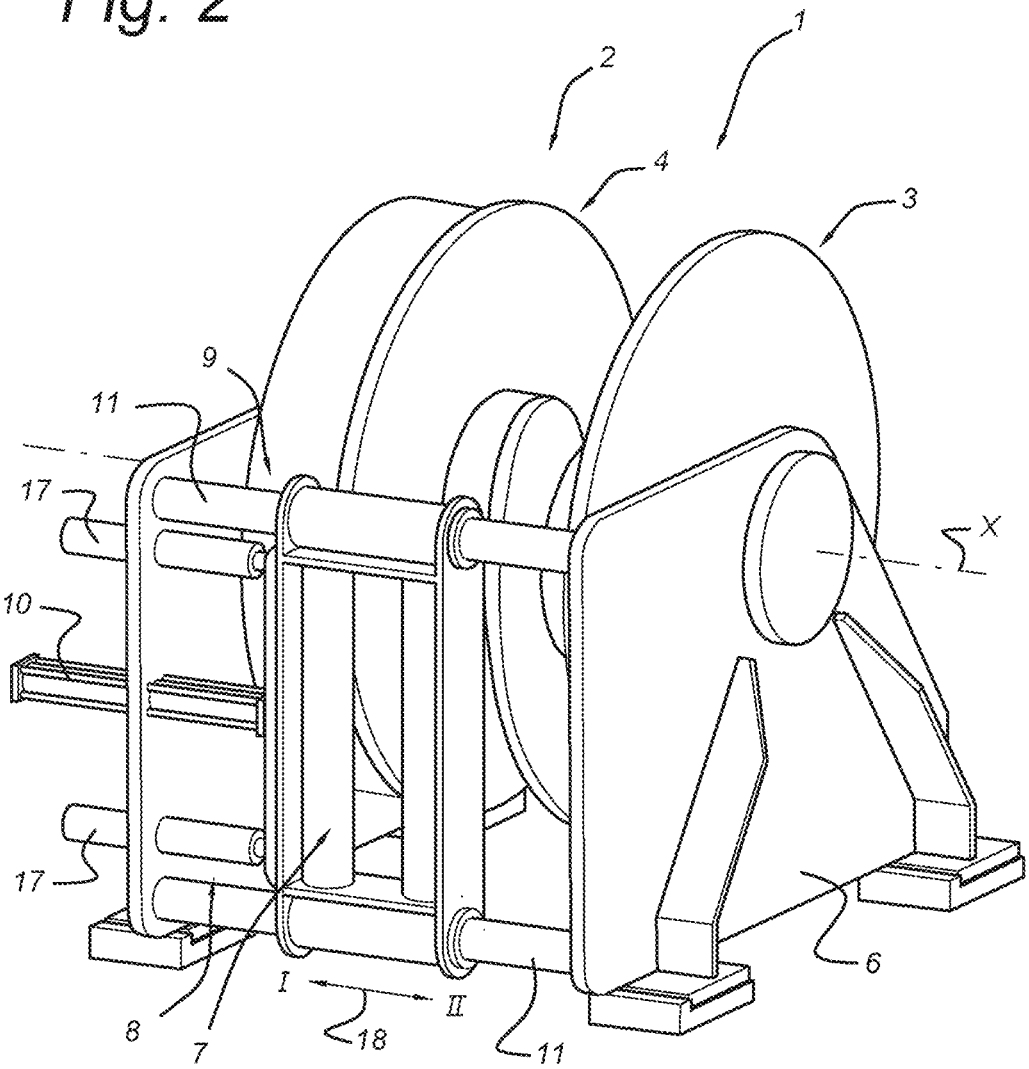
FIG. 2 shows a perspective view of the exemplary embodiment of a retaining device as shown in FIG. 1, but now at a different, second angle.

FIG. 2 shows a perspective view of the same exemplary embodiment of a retaining device as shown in FIG. 1, but now at a second angle.

Figure 3:
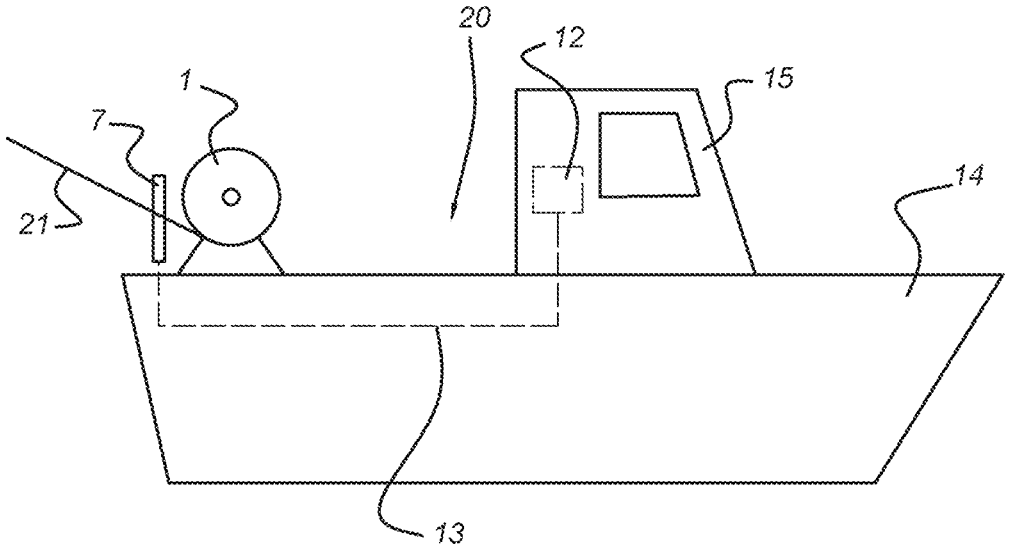
FIG. 3 shows a tug comprising a retaining device according to the invention positioned on the deck thereof.

FIG. 3 shows a tug 14 having a retaining device 1 positioned on the deck thereof. The retaining device 1 is controlled and operated by a winch control arrangement 20 according to the invention. According to the invention, the winch control arrangement 20 comprises remote control means in the form of a control panel 12 in the pilot house 15 of the tug 14. The control panel 12 is communicatively connected via a communication connection 13 to the retaining device 1, and especially to the automatic movement means 8, in order to provide remote control and operation.

When a signal is given via the control panel 12 to start paying in or paying out of the cable the automatic movement means 8 will cause the cable guide 7 to move from the second position II to the first position I (not shown in FIG. 3, please refer to FIGS. 1 and 2). In contrast, when a signal is given via the control panel 12 to stop paying in or paying out of the cable the automatic movement means 8 will move the cable guide 7 from the first position I to the second position II.

Preferably, a predetermined amount of windings, such as 3, are unwound from the eccentric holding part 3 prior to moving the cable guide 7 from the second position II to the first position I. Analogously, a predetermined amount of windings can be wound up onto the eccentric holding part 3 after moving the cable guide 7 from the first position I to the second position II.

Thus, the invention has been described by reference to the embodiments discussed above. It will be recognized that these embodiments are susceptible to various modifications and alternative forms well known to those of skill in the art without departing from the spirit and scope of the invention. Accordingly, although specific embodiments have been described, these are examples only and are not limiting upon the scope of the invention.

REFERENCE NUMERALS

1. Retaining device
2. Drum
3. Eccentric holding part
4. Centric storage part
5. Brake/locking system
6. Frame
7. Cable guide
8. Automatic movement means
9. Guide means
10. Push-pull device
11. Rod
12. Control panel
13. Communicative connection
14. Tug
15. Pilot house
16. Cable support roller
17. Auxiliary push-pull rod
18. Movement direction of cable guide
19.
20. Winch control arrangement
21. Cable
22.

The invention claimed is:

1. Winch control arrangement, comprising a retaining device (1) for a cable (21), comprising a rotatable drum (2) having a rotational axis (X), comprising a substantially circular, centric storage part (4) with a storage surface for containing at least two windings of cable, wherein the distance of the storage surface to the rotational axis is substantially constant, and an eccentric holding part (3) with a holding surface for containing at least two windings of cable, wherein the distance of the holding surface to the rotational axis varies around the circumference of the holding part, wherein a cable guide (7) is arranged at a perpendicular distance from the rotational axis and the drum itself, the cable guide being movable in a movement direction (18) substantially parallel to the rotational axis between a first position (I) for allowing the cable to be wound up on the centric storage part and a second position (II) for allowing the cable to be wound up on the eccentric part, wherein the cable guide is connected to automatic movement means (8) for moving the cable guide between the first (I) and the second (II) positions, wherein the automatic movement means are configured to be controllable by remote control means (12), and remote control means arranged at a distance from the retaining device, wherein the remote control means are communicatively connected (13) to the retaining device for controlling the operation of the automatic movement means, wherein the remote control means are configured to automatically cause the automatic movement means to move the cable guide from the second position to the first position when a signal is given via the remote control means to start paying in or paying out of the cable and/or to move the cable guide from the first position to the second position when a signal is given via the remote control means to stop paying in or paying out of the cable.

2. Winch control arrangement according to claim 1, wherein the retaining device comprises guide means (9) for guiding the movement of the cable guide between the first and the second positions, wherein the automatic movement means comprise a push-pull device (10) attached to drive means to push or pull the cable guide along the guide means between the first and second positions.

3. Winch control arrangement according to claim 2, wherein the guide means comprise one or more rods (11) extending in the movement direction, wherein the cable guide is slideably arranged on the one or more rods.

4. Winch control arrangement according to claim 2, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position.

5. Winch control arrangement according to claim 2, wherein the remote control means comprise a programmable logic controller (PLC).

6. Winch control arrangement according to claim 3, wherein the one or more rods comprise a pair of rods and the push-pull device extends between the pair of rods, in the movement direction (18).

7. Winch control arrangement according to claim 6, wherein the push-pull device comprises a hydraulic actuator.

8. Winch control arrangement according to claim 6, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position.

9. Winch control arrangement according to claim 6, wherein the remote control means comprise a programmable logic controller (PLC).

10. Winch control arrangement according to claim 7, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position.

11. Winch control arrangement according to claim 7, wherein the remote control means comprise a programmable logic controller (PLC).

12. Winch control arrangement according to claim 3, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position.

13. Winch control arrangement according to claim 3, wherein the remote control means comprise a programmable logic controller (PLC).

14. Winch control arrangement according to claim 1, wherein the remote control means are configured to unwind a predetermined amount of windings from the eccentric holding part prior to moving the cable guide from the second position to the first position and/or to wind a predetermined amount of windings onto the eccentric holding part after moving the cable guide from the first position to the second position.

15. Winch control arrangement according to claim 1, wherein the remote control means comprise a programmable logic controller (PLC).

16. Tug (14) comprising a winch control arrangement according to claim 1.

17. Tug according to claim 16, wherein the remote control means are arranged in a pilot house (15) of the tug.

18. Method for operating a winch control arrangement according to claim 1, comprising the steps of:

causing the automatic movement means to move the cable guide from the second position to the first position when a signal is given via the remote control means to start paying in or paying out of the cable and/or causing the automatic movement means to move the cable guide from the first position to the second position when a signal is given via the remote control means to stop paying in or paying out of the cable.

19. Method according to claim 18, wherein a predetermined amount of windings are unwound from the eccentric holding part prior to moving the cable guide from the second position to the first position and/or a predetermined amount of windings are wound up onto the eccentric holding part after moving the cable guide from the first position to the second position.

20. Method according to claim 19, wherein the predetermined amount of windings lies between 2-4.

* * * * *